US005145425A

United States Patent [19]

Little

[11] Patent Number: 5,145,425

[45] Date of Patent: Sep. 8, 1992

[54] SPUD ASSEMBLY FOR DREDGES

[75] Inventor: Charles D. Little, Graceland Park, Md.

[73] Assignee: Ellicott Machine Corporation, Baltimore, Md.

[21] Appl. No.: 703,821

[22] Filed: May 21, 1991

[51] Int. Cl.[5] ..... B63H 19/08

[52] U.S. Cl. ..... 440/36; 37/73

[58] Field of Search ..... 440/36; 37/73, 74

[56] References Cited

U.S. PATENT DOCUMENTS

| | | | |
|---|---|---|---|
| 712,002 | 10/1902 | Packard | 37/73 X |
| 2,092,011 | 3/1936 | Musham | 37/73 |
| 3,656,449 | 4/1972 | Mead | 440/36 |
| 4,033,056 | 7/1977 | Demmers | 440/36 X |
| 4,073,078 | 2/1978 | Leitz | 37/73 X |
| 4,547,162 | 10/1985 | Little | 440/36 |

FOREIGN PATENT DOCUMENTS 296354 3/1914 Fed. Rep. of Germany .

*Primary Examiner*—Sherman Basinger

*Attorney, Agent, or Firm*—Oblon, Spivak, McClelland, Maier & Neustadt

[57] ABSTRACT

A spud is reciprocal through a well carried at the lower end of a reciprocal pole. The pole carries a crane at its upper end to control the vertical position of the spud, the distance between the upper face of the well and the crane being greater than the length of the spud to enable easy replacement of the spud. When the pole and spud are both lowered, up to their maximum extents, the spud can anchor a dredge barge in water having a depth substantially greater than the length of the spud.

7 Claims, 3 Drawing Sheets

SPUD ASSEMBLY FOR DREDGES

SUMMARY OF THE INVENTION

This invention relates to dredges and more particularly to an improved spud assembly wherein a spud can be easily replaced yet is capable of anchoring dredges in water having a depth greater than the length of the spuds.

BACKGROUND OF THE INVENTION

In my earlier U.S. Pat. No. 4,547,162, assigned to the same assignee as the present application, I show, describe and claim apparatus for anchoring a dredge barge with spuds of conventional length in water having a depth in excess of the length of the spuds. The spuds are guided in wells adjacent the lower end of a common spud support which is in the form of a rotatable and reciprocal sleeve with hoist means being mounted on the upper end of the sleeve for controlling the raising and lowering of the spuds within the sleeve. When the spuds are in anchoring condition with the bottom, the wells constitute the sole lateral support for the spuds. Thus should a spud bend, it can almost certainly be raised through the short axial length of the well.

The patented apparatus is satisfactory, particularly for anchoring a dredge barge in exceptionally deep water but it was found to have a problem when it came time to replace a spud. The old spud cannot be easily lifted by apparatus on the dredge barge clear above the sleeve and considerable working time has to be expended just to jack the spud clear of the sleeve and replace it with a new spud.

It is, therefore, one object of the present invention to provide a reciprocal spud support which permits the ready removal of an old spud and replacement by a new one in a minimum of time and with minimum effort and expense.

It is another object of the invention to provide apparatus for accomplishing the foregoing object while still enabling a dredge barge to be anchored in water having a depth greater than the length of the spud.

BRIEF DESCRIPTION OF THE INVENTION

Instead of reciprocally mounting the spuds in a reciprocal rotatable sleeve, a reciprocal pole is provided for each spud. Each pole is slideable in a non-reciprocal guide on the barge, each pole having a spud well adjacent its lower end which extends below and laterally beyond the pole guide. At the upper end of each pole is a spud hoist which may be a crane extending laterally from the pole with its line of action in substantial alignment with the spud well adjacent the lower end of the pole. A spud is slideably received in the well and operatively attached to the crane or other hoist means. The spacing between the upper face of the well and the crane is greater than the length of the spud whereby after a pole is elevated to its fully raised position, the crane can then lift the spud entirely clear of the well for swinging by suitable lanyards or the like, over a place of deposit such as a shore-side berm or another barge, and lowered by the crane to a horizontal position The new spud is then raised by the crane and guided by lanyards over the well whereupon the crane lowers the spud into the well. At the dredging site, the pole is lowered to a position where the well is above the bottom a distance not greater than the length of the spud and the spud is then lowered in the well into anchoring condition in the bottom.

The invention will be better understood when the following detailed description is read in conjunction with the accompanying drawings wherein:

Figure 1:
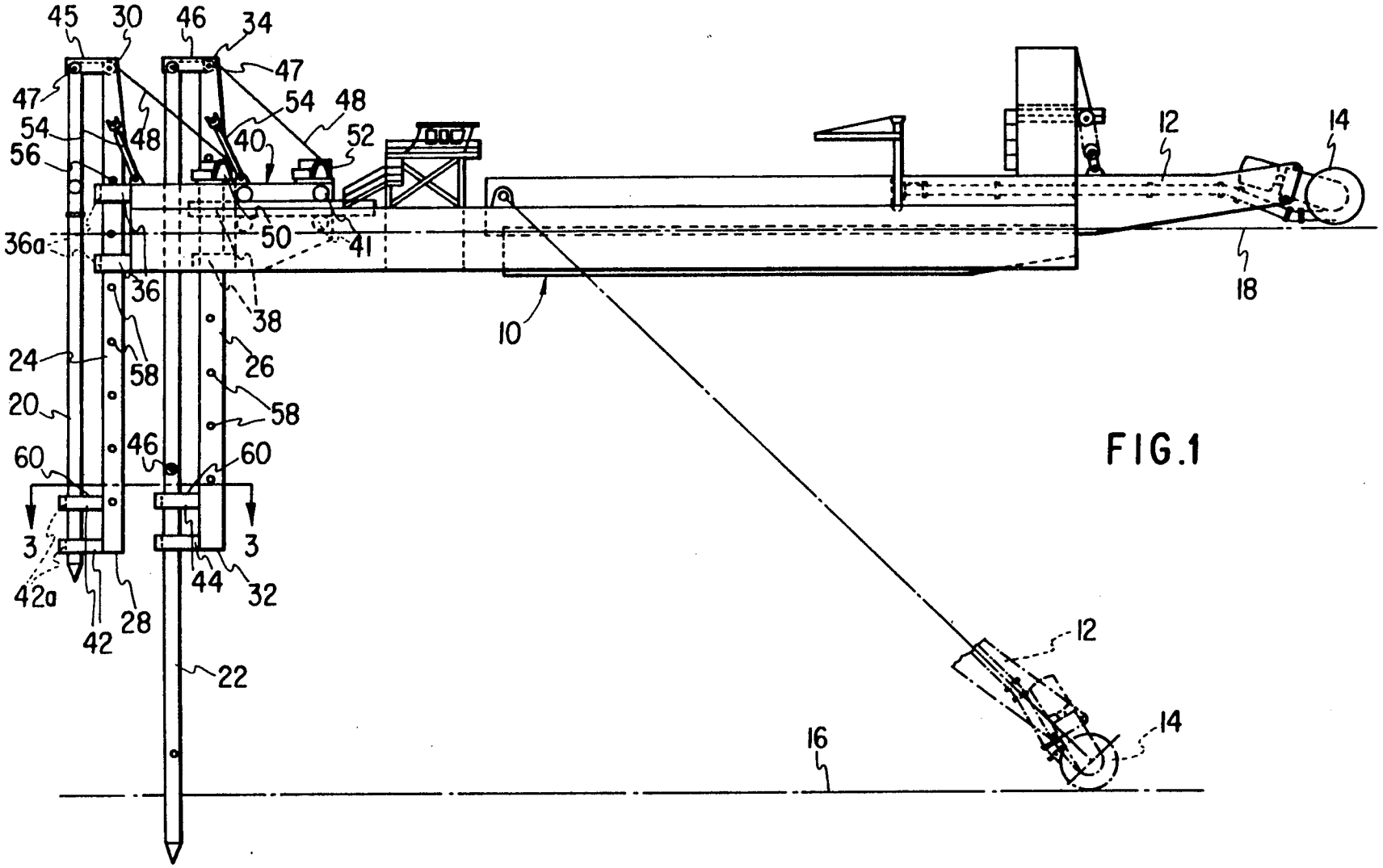
FIG. 1 is a side elevational view of a dredge barge showing the spud assembly of the present invention.

Referring now to the drawings, the numeral 10 designates a barge for a dredge having a ladder 12 which may be swung between the solid line raised position and the lowered phantom line position shown where a cutter wheel 14 is in dredging engagement with the bottom 16 of a waterway, which may below the surface 18 thereof at a depth of up to 200 feet. The barge and dredge is in all respects conventional and will not hereafter be described except as they may pertain to the present invention.

As explained in my prior U.S. Pat. No. 4,547,162, for certain types of dredging in water of exceptional depth, the use of spuds for anchoring and controlling the advance of the barge during dredging is preferable to the exclusive use of anchors which, prior to that invention, was substantially the only means available where dredging was to take place in water having a depth greater than the length of a conventional spud. The present invention is designed to permit anchoring by spuds of conventional length in water of excessive depth just as in my prior patent but the invention has the additional advantage of providing means for the ready removal of an old spud and replacement by a new one.

Figure 3:
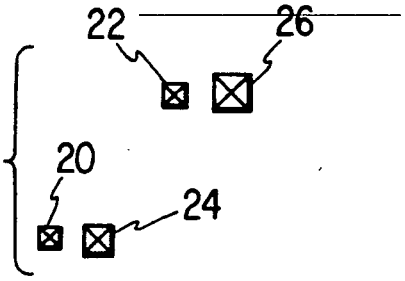
FIG. 3 is a horizontal cross section view taken substantially on the line 3—3 of FIG. 1.

The numerals 20, 22 refer to spuds of conventional length, the spud 20 being a holding spud and the spud 22 being a working spud as described in more detail hereafter. As shown in FIG. 3, the holding spud 20 may be smaller in cross section than the working spud 22 since it is not subjected to the same relatively high level of lateral bending stress as is the working spud 22.

Each spud 20, 22 is associated with an elongated substantially rigid pole 24, 26, having respective upper and lower ends 28, 30 and 32, 34. Each of the poles 24, 26 is received within a respective guide 36, 38. The guide 36 for the pole 24, associated with the holding spud 20, comprises a pair of vertically spaced collars fixed to the stern of the barge. The guide 38 is a pair of vertically spaced collars fixed to the aft end of a wheeled trolley 40 mounted on wheels 41. The trolley 40 is movable by an hydraulic cylinder 42 fore and aft over an open slot 44 through the aft end of the barge. The collars of the fixed guide 36 are mounted on the hull laterally to one side of the path of movement of the trolley 40. The aft walls of all the pole guide collars are hingedly connected to the side walls of the collars, as shown at **36*a* in FIG. 2**, to facilitate mounting of the poles within the guides. The use of a holding spud operating to one side of a working spud which is movable fore and aft on a trolley to control the movement of a dredge barge during dredging operations is known, see, for example, British patent No. 176,792 (1921). A spud trolley which is movable by a hydraulic cylinder is known as, for example, in U.S. Pat. to Van der Gaag No. 3,648,998.

Adjacent the lower end of each pole 24, 26 is a spud well 42, 44 which may be in the form of pairs of vertically spaced collars which are sufficiently close together to permit a moderately bent spud to be elevated through the collars of the wells. The wells 42, 44 extend laterally from the poles below and beyond the respective pole guides 36, 38. The aft walls of all the spud guide collars are hingedly connected to the side walls of the collars, as shown at 42*a* in FIG. 2, to facilitate removal of severely bent spuds. Spud hoist means are carried by the poles 24, 26 above the guides 36, 38. The hoist means are preferably in the form of laterally extending cranes 45, 46 fixed to the respective upper ends 30, 34 of the poles 24, 26 with their lines of action in axial alignment with the wells 42, 44.

The spuds 20, 22 are slideably received in the respective wells 42, 44 and are operatively connected by blocks 46, sheaves 47 in the cranes, and falls 48 to respective winches 50, 52 mounted on the barge deck and on the trolley 40, respectively.

Figure 4:
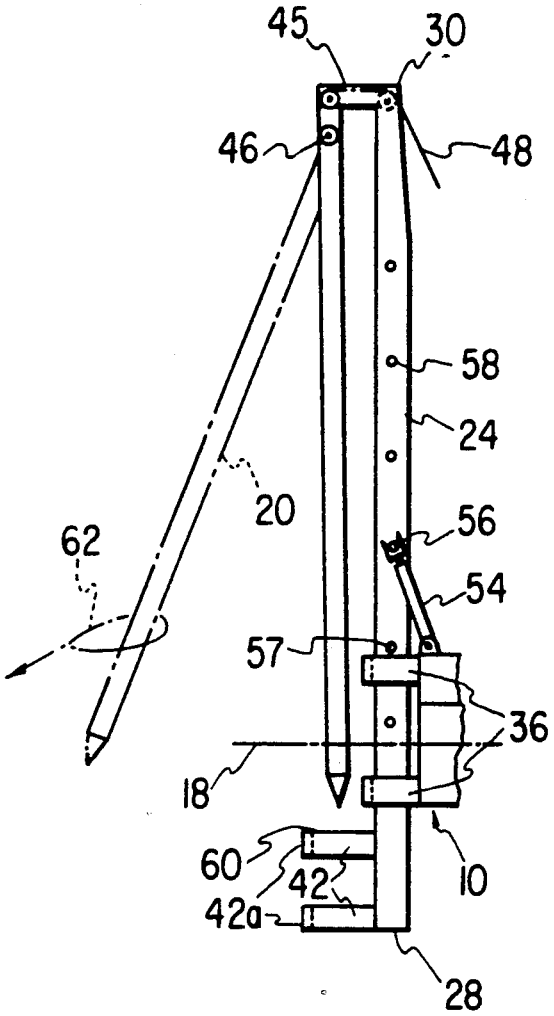
FIG. 4 is a broken elevational view showing the manner by which a spud may be removed for replacement.

As can be seen, means are provided for raising and lowering the poles. Conveniently, these may comprise hydraulic jacks 54, each of which operates against a removable pin 56, slideable into and out of spaced holes 58 in the side of a pole as best seen in FIG. 4, where the pole 24 for the holding spud 20 is shown in its elevated position. In any position of a pole, it is retained in that position by a second pin 57 which is received in a hole 58 and engages the upper face of a pole guide 36 or 38. When a pole is to be raised, the cylinder 54 is extended against a pin 56 and the pole is raised until a hole is positioned just above the upper face of the guide whereupon a pin 57 is slid into that hole, the hydraulic cylinder is retracted until the weight of the pole is sustained by the pin 57 whereupon the cylinder is fully retracted until its clevis is just below the next hole above the one which received the retaining pin 57. A pin 56 is inserted in that hole and the cylinder extended, with this process being repeated until the pole is at the desired elevation. To lower the pole the reverse procedure is followed. It will be apparent that other means may be used for raising and lowering the poles.

In accordance with the invention the distance between the upper face 60 of a well, say well 42 as shown in FIG. 4, and crane 45 is greater than the length of a spud 20. Thus, if it is desired to replace a spud the pole is first jacked to its fully raised position as shown in FIG. 4 and if the spud was in its fully lowered position at the start of the jacking operation, it will be seen that, with the winch stopped, as the pole is raised the fall sheaves and blocks will also automatically raise the spud with respect to the pole, at least to a certain degree. When the pole is in its fully raised position the winch may have to be operated to raise the spud clear of the well as seen in FIG. 4 whereupon a lanyard 62 may be connected to the spud to pull it away from the barge as the winch 50 is operated to lower the spud. The spud may be guided by the lanyard over a water-side berm or a storage barge onto which the spud is lowered until the spud is horizontal. The block 46 may then be connected to a replacement spud which is thereafter raised to a vertical position over the well and lowered there into.

Figure 2:
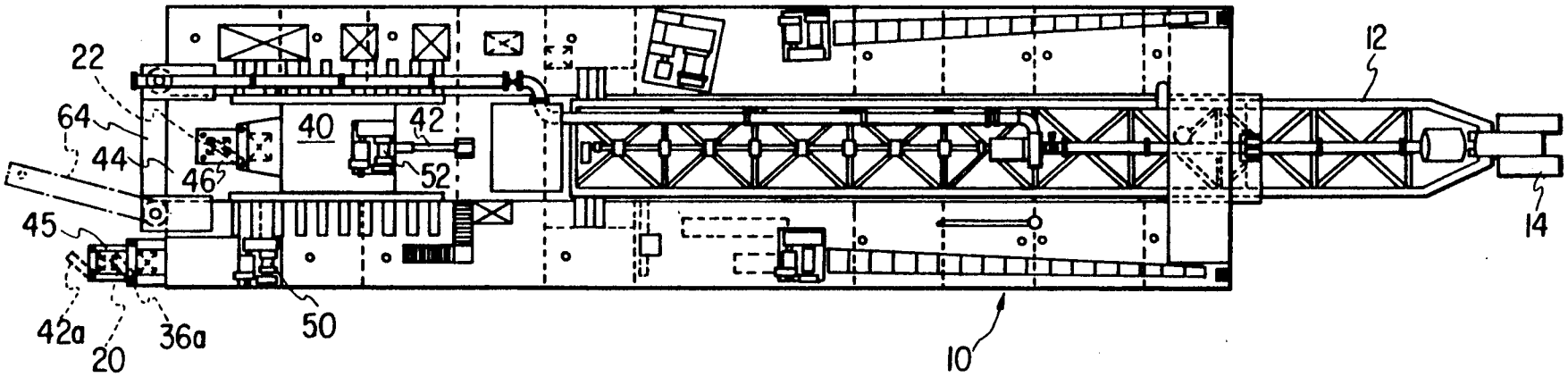
FIG. 2 is a top plan view of the barge of FIG. 1.

Though both spud 22 and 24 are handled in the manner just described it will be noted in FIG. 2 that a structural member 64 bridges the aft end of the slot 44 in order to firmly connect together the rear end parts of the barge on either side of the slot. When the working spud 22 is to be removed one end of the structural member is disconnected from one of the rear end parts of the barge and swung rearwardly as shown by the phantom lines so that the rear end of the slot 44 is clear to permit the working spud 22 to be swung clear of the barge as just described for the holding spud 24.

With reference to FIG. 1 it will be seen that the invention permits a barge to be anchored by spuds of conventional length in water having a depth greater than the length of the spud, the wells 42, 44 providing the sole guides and lateral supports for spuds 20, 22.

In operation, let it be assumed that the depth of water at the dredging site is greater than the length of a spud but not greater than the combined length of the poles and spuds when lowered to their maximum extent. At the dredging site, the poles are lowered to their maximum extent. At the dredging site, the poles are lowered to a position wherein the distance from the wells 42, 44 to the bottom is not in excess of the length of the spuds. The spuds are then alternately raised. The holding spud 20 is raised after the trolley 40 has been moved to the forward end of the slot and the working spud 22 lowered into anchoring position. The hydraulic cylinder 42 then moves the trolley 40 aft to advance the barge in coordination with dredging operations. When the trolley reaches the rear end of the slot, the holding spud is lowered into anchoring position, the working spud raised and the trolley retracted to the forward end of the slot whereupon the working spud is lowered and the holding spud raised with this process being repeated until dredging is completed.

Should it be necessary to replace one of the spuds, the other is lowered into anchoring position, the pole of the spud to be replaced is jacked to its maximum raised position and the spud is then raised by the crane above its well and is replaced as has been explained above.

Though the spud and pole arrangement of the invention has been described in connection with anchoring in water of excessive depth, the arrangement can be used for anchoring in water of any depth less than the maximum and which may in fact be comparatively shoal.

Having now described the invention what is claimed is:

1. Incombination with a barge carrying a dredge, a spud assembly comprising an elongated substantially rigid pole having upper and lower ends, a non-reciprocal guide carried by said barge and slideably receiving said pole, a spud well adjacent the lower end of said pole and extending laterally from said pole below and beyond said guide, spud hoist means carried by said pole above said guide, a spud received in said well and operatively connected to said hoist means whereby said spud may be raised and lowered with respect to said well and said pole, elevating means for raising and lowering said pole in said guide with respect to said barge, said elevating means being operable to maintain said pole and said well at all times during use clear of the bottom of a waterway, said well providing the sole guide and lateral support for said spud when it is in anchoring position in the bottom of a waterway, wherein said spud assembly is constructed and arranged for use in anchoring said barge on the bottom of a waterway having a depth greater than the length of said spud but not greater than the combined length of said pole and spud when lowered to their maximum extents, said elevating means being operable to lower said pole to a position such that the distance between said well and said bottom is not in excess of the length of said spud, said hoist means being operable to lower said spud in said well until its lower end is in anchoring condition with said bottom and at least its extreme upper end is entirely within said well means.

2. The combination of claim 1 wherein said hoist means comprises a crane extending laterally from the upper end of said pole with its line of action in substantial alignment with said well.

3. The combination of claim 1 wherein said well has an upper face, the distance between said upper face and said hoist means being greater than the length of a spud whereby a spud may be raised by said hoist means above said well for subsequent lateral swinging clear away from said support.

4. The combination of claim 1 wherein said pole guide is fixed to the stern of said barge.

5. The combination of claim 1 wherein said pole guide is mounted on a support movable over the water surface in a fore and aft direction relative to said barge, and power means for moving said support relative to said barge.

6. The combination of claim 5 wherein said support is a wheeled trolley bridging an open slot through said barge and said pole and spud extends through said slot when in their anchoring position.

7. The combination of claim 5 wherein said spud is a working spud, a second guide, pole and spud, said second guide being fixed to said barge laterally out of alignment with the path of movement of said movable support, said second spud constituting a holding spud to anchor said barge in a stationary position when said working spud is out-of anchoring engagement with the bottom.

* * * * *